United States Patent [19]

Perry

[11] Patent Number: 4,831,794

[45] Date of Patent: May 23, 1989

[54] SYSTEM FOR FORMING A SLOPED SURFACE ON A FLAT ROOF DECK

[76] Inventor: Kenneth W. Perry, 20531 NW. 20th Ct., Miami, Fla. 33056

[21] Appl. No.: 164,681

[22] Filed: Mar. 7, 1988

[51] Int. Cl.[4] ..... E04B 7/02

[52] U.S. Cl. ..... 52/90; 52/94; 52/309.11; 52/22

[58] Field of Search ..... 52/22, 90, 309.11, 94

[56] References Cited

U.S. PATENT DOCUMENTS

| | | | |
|---|---|---|---|
| 4,014,143 | 3/1977 | Purcell | 52/90 |
| 4,021,981 | 5/1977 | Van Wagoner | 52/90 |
| 4,192,108 | 3/1980 | Lowe | 52/90 |
| 4,435,926 | 3/1984 | Struben | 52/22 |
| 4,619,100 | 10/1986 | Emblin | 52/90 |
| 4,620,397 | 11/1986 | Simpson | 52/90 |
| 4,631,878 | 12/1986 | Laramore | 52/90 |

FOREIGN PATENT DOCUMENTS

| | | | |
|---|---|---|---|
| 1151563 | 1/1958 | France | 52/22 |
| 747954 | 7/1980 | U.S.S.R. | 52/90 |
| 576540 | 4/1946 | United Kingdom | 52/22 |
| 966931 | 8/1964 | United Kingdom | 52/22 |

*Primary Examiner*—Henry E. Raduazo

[57] ABSTRACT

A system for the formation of a sloped roof surface on a pre-existing flat roof deck through the utilization of a mold assembly comprising a plurality of angularly configured beams spaced from one another and cooperatively interconnected with baffle plates and an overlying grill structure having a substantially open or pass-through construction to the extent that a confined space defined by the above set forth component is to be filled with a light-weight cementitious or other operable material preferably suitable for roofing, resulting in an inclined or sloped outer surface being formed contiguous with the grill structure such that the cured cementitious material and aforementioned components become a substantially integral, one-piece construction permanently secured to the pre-existing, original flat roof deck.

17 Claims, 2 Drawing Sheets

SYSTEM FOR FORMING A SLOPED SURFACE ON A FLAT ROOF DECK

BACKGROUND OF THE INVENTION

1. Field of the Invention

This invention relates to a system for forming a sloped roof surface on an original flat roof deck utilizing a plurality of specifically configured and cooperatively structured components to define a forming mold-like assembly in which applicable cementitious material is poured and cured in a desired configuration defined by the mold assembly to form a permanent installation.

2. Description of the Prior Art

A flat deck roof construction, while used extensively in both commercial and domestic buildings, has certain and specifically recognized disadvantages. Such disadvantages relate primarily to the ineffective drainage characteristics of flat roof decks and the resulting leakage problems associated therewith.

In an attempt to overcome these recognized problems, numerous designs and construction systems have been developed in the prior art to efficiently construct, form, etc. an inclined or sloping surface on a pre-existing or original flat roof deck. The advantages in forming a sloped roof surface would at least in part relate to improved drainage characteristics associated with the roof as well as providing certain other advantages such as greater insulation characteristics, etc.

The aforementioned prior art attempts to overcome the above set forth problems are demonstrated in the following United States patents.

Kelly, U.S. Pat. No. 4,642,950 discloses a reroofing construction assembly using sloping plateau forming insulation provided for creating a sloped roof on a flat roof deck consisting of a plurality of insulation blocks or sheets some of which may be tapered and some of which may be provided with plane surfaces of laminated construction consisting primarily of styropore block.

The patent to Rumble, U.S. Pat. No. 2,598,607 is directed to a molded roof structure comprising a number of rafter members secured to the roof for supporting a roof covering at a predetermined pitch inclination above the walls of the building. In addition, a web formation extends between and connects the rafter members wherein both the rafter members and the web formation are formed of a concrete molded material formed in place on the roof.

The patent to Peeler et al., U.S. Pat. No. 2,948,047 is directed to a method of building structures through the formation of screen-like grid reinforced with re-bar elements and used primarily for the erection of shell-type buildings wherein a cementitious coating is placed over the grid-like members.

The patent to Loggy, U.S. Pat. No. 4,683,689 is directed to a modular reinforced building structure preferably of an elongated hexagonal shape wherein the building structure is constructed on temporary, removable frames by disposing metal lath over a roof frame in the desired configuration of the finished roof portion. Concrete is applied to the lath portion of the wall and roof and allowed to cure.

The patent to Gamber, U.S. Pat. No. 3,324,611 relates to the formation of reinforced concrete structures including the formation of a sloped roof supported by interlocking pluralities of steel reinforcing rods to form a self-rigidising frame work which is covered with metallic screen adapted to receive a coating of predetermined thickness of hydraulically sprayed concrete.

Although applicable for their intended functions, the structures, systems, methods, etc. disclosed in the above-noted patents still do not constitute a simple, inexpensive and efficient means of construction in the conversion of flat roof decks to outer or exposed sloped surfaces utilizing a cementitious material which is effectively applied in place and allowed to cure in the desired configuration and as a permanent installation on the pre-existing or original flat roof deck.

SUMMARY OF THE INVENTION

The present invention is directed to a system for the formation of pitched or sloped roof surface as a permanent installation on a pre-existing or original flat roof deck of a building structure. The system of the present invention contemplates the utilization of a mold-like structure in which light-weight, cellular concrete or like cementitious material having the desired structural characteristics is poured. It is emphasized that any applicable material could be utilized other than the cementitious material set forth above as long as it is capable for use as roofing material. The configuration of the exposed outer surface of the resulting structure is a sloped-roof surface of desired pitch permanently affixed to the mold-structure and positioned overlying the pre-existing flat roof deck.

The aforementioned mold-structure comprises a plurality of elongated beam structures which may be referred to as "T" beams having a lower longitudinal side affixed to the pre-existing flat roof deck. The upper longitudinal side has an angular or inclined configuration extending from a first end to a second, opposite end of the beams. The beams are disposed in parallel, spaced-apart relation to one another and the beams may be of a variety of lengths and may vary in number depending upon the size of the flat roof deck to be covered.

A plurality of "T" beams are connected to and used in conjunction with intermediately positioned and transversely oriented baffle plates also spaced in parallel relation to one another wherein the baffle plates are structured to have progressively increasing heights or transverse dimensions from a first end of the beam to a second end of the beam. The baffle plates increase in transverse dimension as the incline or transverse dimension of the plurality of T beams increase.

By virtue of this construction, a confined space is defined comprising a plurality of compartments being formed between each of two adjacent beam structures and further wherein each compartment has an increasingly greater volume as they progress from a first end of the plurality of beams to the second end, as the transverse dimension of both the baffle plates and the beam structures increase.

A grill means comprising at least one but preferably a plurality of grill structures are placed effectively between each adjacent pair of beams and above and in overlying relation to the aforementioned plurality of baffle plates and confined space. Each one of the grill structures has an open or pass-through construction which enables pouring of the light-weight, cellular concrete or like cementitious material therethrough. Accordingly, the confined space is filled with the cementitious material introduced through the grill structures until the confined space is filled and the upper level of the cementitious material is contiguous to and has an equivalent inclined configuration as the placement of the grill structures. The outer surface of the formed slope roof may be made smooth using any manual or other conventional techniques known in the construction industry.

The aforementioned components of the mold structure are left in place and effectively become integral with the cementitious material after it cures. The entire mold structure and cured light-weight concrete become a permanent installation fixedly secured on the previously, pre-existing flat roof deck.

The amount of pitch on the formed outer roof surface of the resulting angled roof deck may vary. However, a preferred minimum degree of pitch would be one-eighth inch rise from the first end of the plurality of beam structures with each linear foot along the length of the beam structure to the second end.

The invention accordingly comprises the features of construction, a combination of elements and an arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 3:
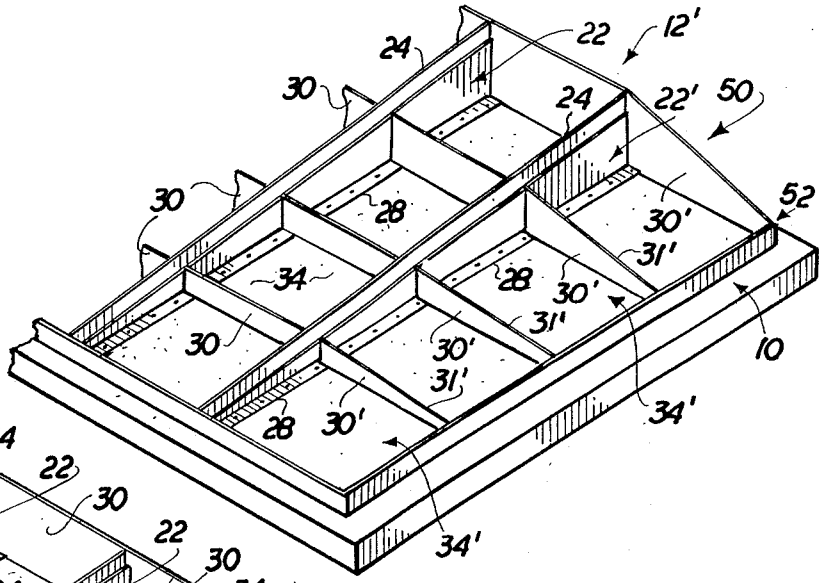
FIG. 3 is a perspective view in partial cut-away of another embodiment of the present invention.

As shown in the figures to be described in greater detail hereinafter, the present invention is directed towards a system for forming a sloped roof surface on an original or pre-existing flat deck roof generally indicated as 10. The system comprises the utilization of a mold-like assembly generally indicated as 12 in which a cellular or light-weight concrete or other applicable cementitious material is poured, formed and allowed to cure and further wherein such cementitious material is indicated as 14. After curing, within the mold assembly 12, an outer exposed surface 16, being sloped at the desired pitch is the result. From a detailed description hereinafter, it is apparent that the cementitious material 14 cures and becomes an effectively integral part of the various components of the mold assembly wherein the cured cementitious material or concrete 14 and the mold-like assembly 12 become a permanent installation affixed to and resting on the pre-existing flat roof deck 10.

Figure 1:
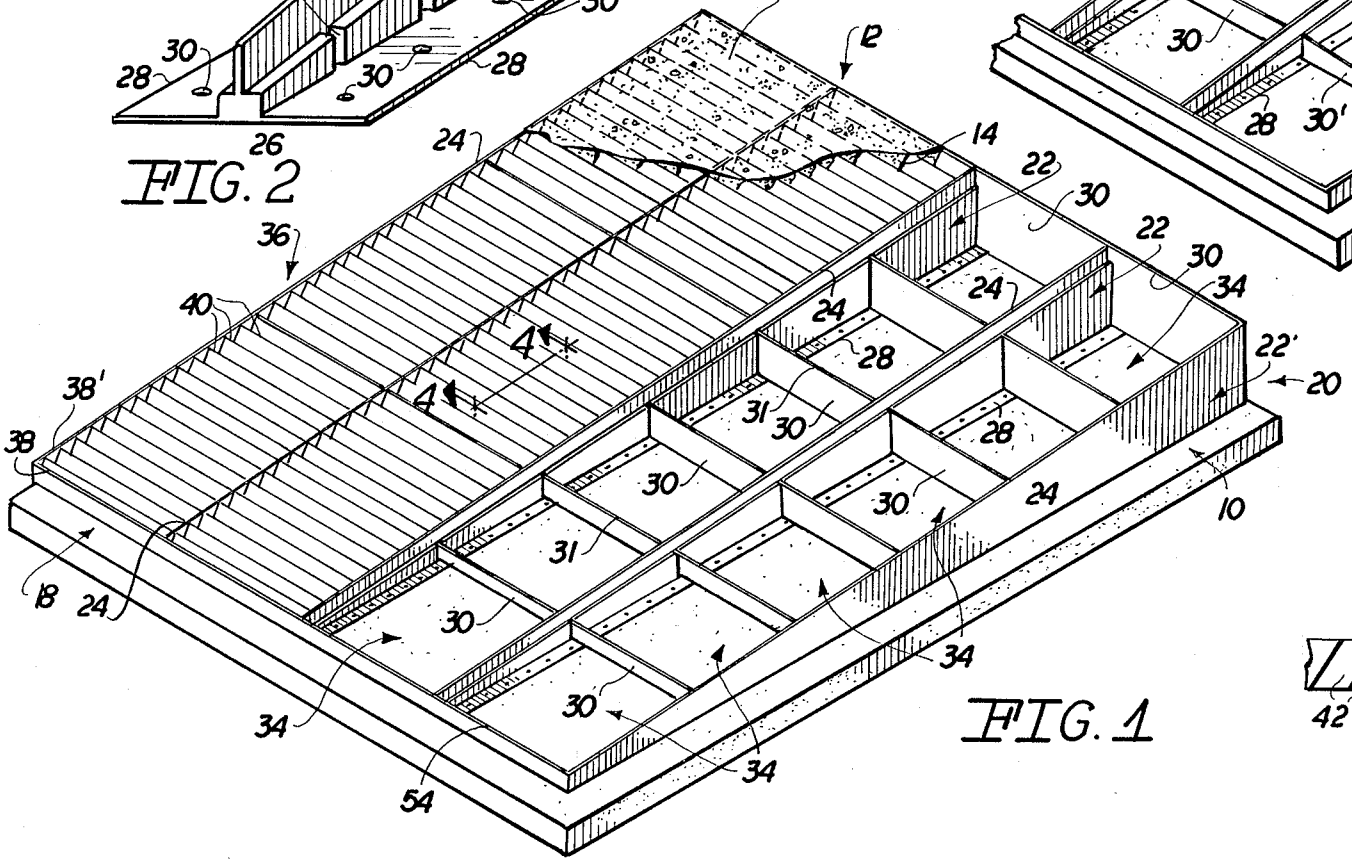
FIG. 1 is a perspective view of the assembly of the present invention in partial cut-away.

For purposes of clarity, the mold assembly 12 includes a first or front-end 18 and a second or back-end 20 as indicated in FIG. 1. The various components of the mold assembly 12 are preferably formed from a plastic material having sufficient structural integrity to serve the purpose indicated. However, it should be noted that materials other than plastic can be utilized for the various components.

The mold assembly 12 comprises a plurality of elongated beam structures 22 having an elongated upper longitudinal side 24 angularly oriented at a predetermined incline as the length of the longitudinal side 24 extends from the first or front end 18 to the second end 20. The degree of incline may vary with the overall size of the pre-existing flat roof deck 10. However, a minimum pitch or incline should exist having the perimeters of one-eighth inch rise to each linear foot of length of the beam structure 22. As further will be explained in greater detail hereinafter, the angular inclination of the upper longitudinal edges 24 of the plurality of beams 22 effectively establish the pitch of the resulting sloped roof surface 16.

An attachment plate in the form of a flange extending out at least on one side of each of the beam structures 22 and indicated as 28 is secured to the bottom longitudinal side 26 of each of the beam structures 22. Attachment plate or flange 28 extends outwardly from both sides or surfaces of at least a majority of each of the beam structures 22 and includes a plurality of apertures or like structures 30 formed therein. The apertures 30 are disposed in spaced-apart relation to one another and are specifically adapted to allow conventional connectors such as screws, bolts, etc. to pass therethrough into penetrating relation with the pre-existing flat roof deck 10. Therefore, it should be readily apparent that the plurality of beam structures 22 are fixed to the flat roof surface 10 in spaced-apart, parallel relation to one another as clearly shown in FIG. 1. The end-most beam structures as at 22' may include only a single attachment flange or plate 28 extending from an interior surface thereof towards the next adjacent beam structure.

Figure 2:
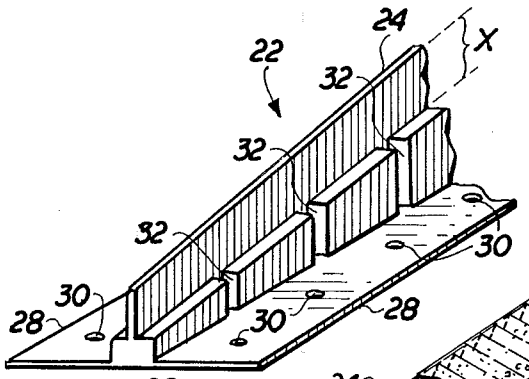
FIG. 2 is a perspective view of a beam structure associated with the assembly of the present invention in partial cut-away.

The mold-like structure or assembly 12 further includes a plurality of baffle plates 30 of progressively greater height or transverse dimension extending in parallel, spaced-apart relation to one another between adjacent ones of the beam structures 22 as best shown in FIG. 1. The transversely oriented baffle plates have their opposite ends engaging or being connected to the adjacently positioned ones of the beam structures 22 by means of the existence of spaced-apart channels 32 which may be integrally formed in one or both faces of the beam structure 24 as shown in greater detail in FIG. 2. The progressively greater height or transverse dimension of each of the plurality of baffle plates accounts for the inclined configuration of the upper longitudinal end of the beam structure 22 as at 24. Accordingly, the interconnection and cooperative configuration of the baffle plates and the interconnected beam structures 30 and 22 respectively, serve to define a confined space which itself is defined by a plurality of individual compartments 34. These compartments 34, of course, have increasingly greater volume as they extend from the first or front end 18 to the second end 20 of the plurality of beam structures and the mold assembly 12. Naturally, the increase in the height or transverse dimension of the baffle plates corresponds to the increase in height or transverse dimension of the respective beam structures 22 from the first to the second end 18 and 20 respectively. The actual height of such baffle plates and beam structures progressively depends upon the intended or predetermined amount of pitch desired on the sloping roof 16. As clearly shown in FIGS. 1 and 2, the baffle plates 30 have an upper longitudinal edge 31 which are spaced or recessed inwardly from the upper longitudinal side 24 of each of the beams.

Figure 4:
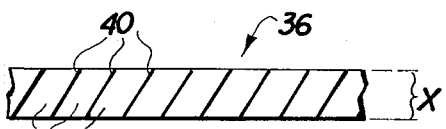
FIG. 4 is a sectional view in partial cut-away along line 4—4 of FIG. 1.

This spacing is provided to accommodate grill means including a plurality of grill structures generally indicated as 36. Each one of the plurality of grill structures 36 comprises a peripheral border or frame 38 formed of plastic material wherein opposing longitudinal portions 38' of the grill structures 36 are interconnected by elongated slats defining bracing members as at 40. The slats 40 are disposed in spaced apart parallel relation to one another as clearly indicated in FIG. 4 and the spacing therebetween as at 42 defines an open, pass-through construction having sufficient dimension to allow the ingress or passage and directing of the cementitious material 14 into the interior of the confined space including each of the various compartments 34.

Since the plurality of grill structures 36 are disposed in covering relation to what may be considered an inclined opening defined by the upper longitudinal sides 24 of the beam structures, the cementitious material may effectively fill each of the various compartments 34 to a point where the filled cementitious material protrudes through the spacings 42 between the bracing slats 40 (see FIGS. 1 and 4) and is contiguous to the exposed surface of each of the grill structures 36. The exposed amount protruding outwardly from the individual bracing slats 40 of course defines the sloped surface 16 having the desired pitch equal to the angular orientation of the grill structures 36 which in turn is substantially equal to the angle of incline of the upper longitudinal sides 24 of the plurality of spaced apart and parallel oriented beam structures 22. In order to adequately support and fit the grill structures 36 in the position shown in FIG. 6, their transverse dimension or height is substantially equal to the distance between the upper ends of the channels 32 and the upper longitudinal sides 24, such distance indicated as X in FIGS. 2 and 4. In actual use, such thickness or height of the grill structures may be in the vicinity of approximately ½ to 1 inches, but of course may vary. Another feature associated with the grill structures 36 is the angled orientation of the bracing slats 40 being somewhat less than 90 degrees relative to the length or longitudinal axis of the grill structures 36 as clearly shown in FIG. 4. This facilitates pouring of the material within the confined space.

Yet another embodiment of the present invention shows the ability of the subject mold-like assembly or structure 12' to form a multi-sloped surface such as at the ends of the roof generally indicated as 50. In order to accomplish a different "side angle" or pitch at these end portions of the formed sloped roof surface, a plurality of auxiliary baffle plates 30' may be secured to the end-most beam structure 22' in the manner set forth and described with regard to the interconnection of baffle plates 30 with adjacent ones of the beam structures 22 in FIG. 1. However, the upper longitudinal edges 31' are also angularly declining as they extend from a first end or beam structure 22' to a distal or second end generally indicated as 52. Appropriately configured and modified grill structures may also be placed over the resulting compartments 34' in order that such compartments may be filled with the cementitious material similar to that shown in explanation in the embodiment of FIG. 1. End plates or planks 54 may be applied to the first end 18 of the beam structures 22 as at 54 in order to prevent run-out or inadvertent displacement of the cementitious material as the end-most compartments are filled.

Figure 5:
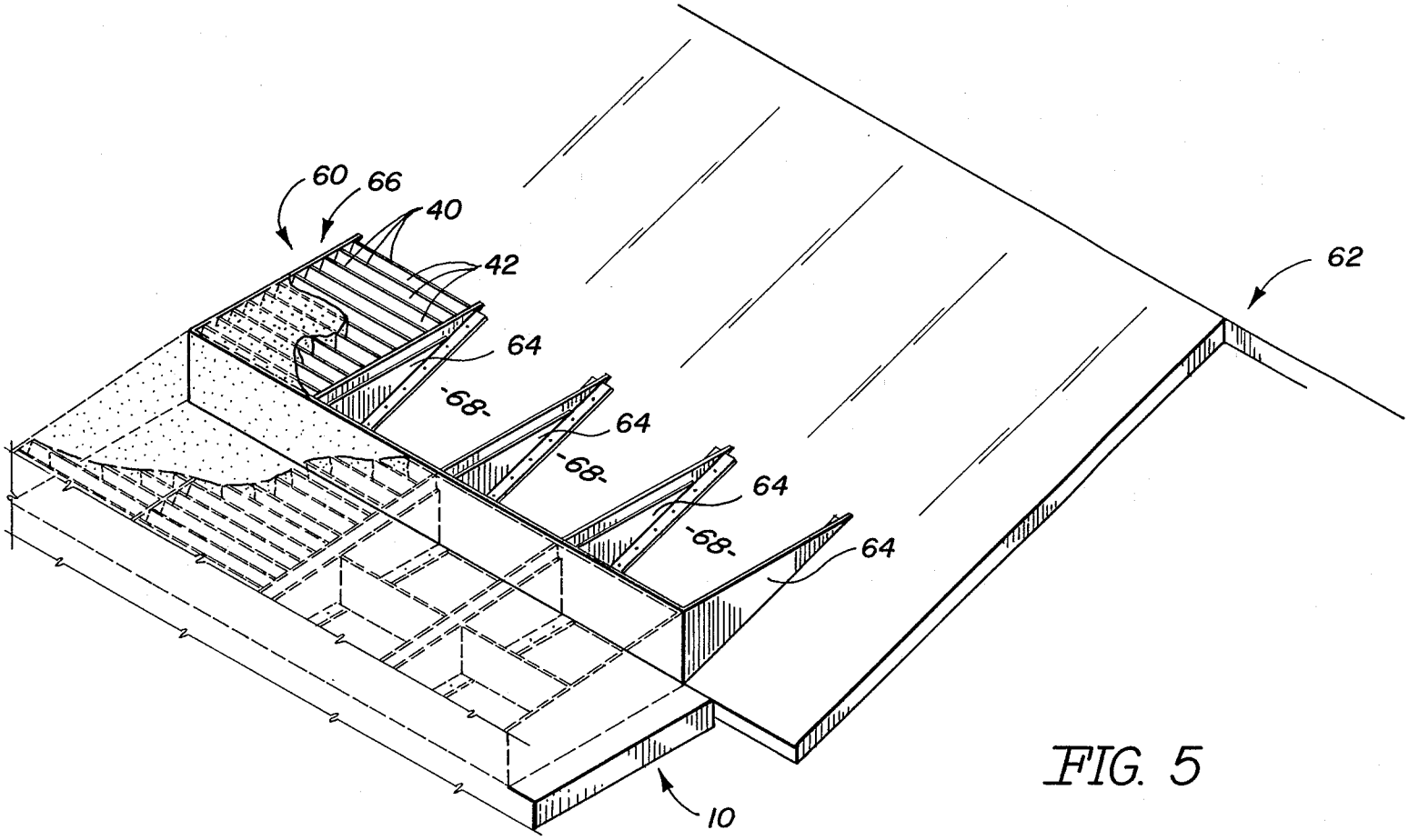
FIG. 5 is a perspective view in partial cut-away of yet another embodiment of the present invention.

As shown in FIG. 5, an additional embodiment of the present invention is additional structure associated with the embodiment basically shown in FIG. 1 and may be considered a tie-in assembly generally indicated as 60 specifically structured, disposed and connected in cooperative relation to the plurality of beam structures in the mold assembly represented in FIG. 1 for the purpose of tying such mold assembly as shown in FIG. 1 into a gable roof such that there will be a substantially continuing sloping roof surface in construction situations where a flat roof deck 10 extends outwardly from the end of a gabled roof generally indicated as 62. The tying assembly 60 includes a plurality of what may be considered substantially triangular beam extensions 64 disposed in spaced apart parallel relation to one another as shown and which do not necessarily include interconnecting baffle plates as in 30 in the embodiment of FIG. 1. However, relatively shortened grill structures 66 are disposed in overlying or covering relation to the adjacently positioned ones of the triangular beam members 64 wherein the grill structures 66 are identical in construction to the grill structures 36 shown in FIGS. 1 and 4 with the exception being that they are smaller and specifically dimensioned to cover the resulting extended compartments 68 formed at the end of the mold assembly 20 of the type shown in FIG. 1. Light-weight cementitious or any other applicable material is poured through the individual slats 40, through spaces 42 (see FIG. 4) so as to effectively fill the various compartments or spaces 68 to a point where the roofing material may raise through the individual slats, through spaces 42 and form a sloped surface similar to that as represented at 16 in FIG. 1.

Now that the invention has been described, what is claimed is:

1. A system for forming a sloped roof surface on a flat roof deck, said system comprising:

a. a plurality of beam structures each having an elongated configuration and disposed in spaced, substantially parallel relation to one another collectively along a length of the flat roof deck, b. each of said beams secured to the roof deck along a bottom longitudinal side thereof and comprising a top longitudinal side angularly inclined from a first end to a second end thereof, c. a plurality of baffle plates transversely interconnected between each-two adjacent beam structures and being disposed in spaced, parallel relation to one another along the length of said beam structures, d. said plurality of baffle plates comprising successively greater transverse dimensions from said first to said second end of said beam structures, e. said beam structures and said plurality of baffle plates cooperatively structured to define a confined space having an inclined opening extending between said first and said second ends of said plurality of beams, and f. grill means for covering said confined space positionable at an incline substantially equal to the incline of said plurality of beam structures and said inclined opening and in overlying, substantially covering relation to said baffle plates and said confined space in spaced-relation to the flat-roof deck and including an open, pass through construction for directing a moldabe roofing material therethrough into said confined space.

2. A system as in claim 1 wherein said grill means comprises at least one grill structure having a bordering frame disposed about a periphery thereof and a plurality of brace members connected to said frame and disposed in spaced-relation to one another a distance sufficient to allow passage therethrough of the moldable material.

3. A system as in claim 2 wherein said plurality of brace members comprise a plurality of slats disposed in spaced, parallel relation to one another and connected between oppositely disposed portions of said frame and in transverse orientation relative to the length of said beam structures.

4. A system as in claim 3 wherein said plurality of slats are disposed at an angular orientation of less than 90 degrees relative to the length of said one grill structure.

5. A system as in claim 1 wherein said grill means comprises a plurality of grill structures each comprising a bordering frame disposed about a periphery thereof and a plurality of brace members connected to said frame and disposed in spaced-relation to one another a distance sufficient to allow passage therethrough of the moldable material and dimensioned to fit between adjacent ones of said beam structures, said plurality of grill structures sufficient in number to substantially cover said inclined opening in overlying relation to said confined space.

6. A system as in claim 5 wherein said plurality of brace members of each grill structure comprises a plurality of slats disposed in spaced, parallel relation to one another and connected between oppositely disposed portions of said frame and in transverse orientation relative to the length of said beam structures.

7. system as in claim 6 wherein said plurality of slats are disposed at an angular orientation of less than 90 degrees relative to the length of said one grill structure.

8. A system as in claim 7 wherein each of said plurality of baffle plates are dimensioned to include an upper longitudinal edge spaced an equal distance inwardly from said top longitudinal side of adjacent ones of said beam structures.

9. A system as in claim 8 wherein each of said plurality of grill structures are transversely dimensioned to be disposed between adjacent ones of said plurality of beam structures in supported engagement on said upper longitudinal edges of said baffle plates.

10. A system as in claim 1 wherein said confined space comprises a plurality of open compartments defined by cooperatively positioned interconnected baffle plates and beam structures, said compartments comprising progressively greater volumes extending from said first end to said second end of said plurality of beams.

11. A system as in claim 10 wherein each of said compartments are disposed and structured to be filled with the roofing material to a level contiguous to said grill means, whereby a sloped outer roof surface is defined contiguous with said grill means.

12. A system as in claim 1 wherein each of said beam structures comprises an attachment plate secured to said lower longitudinal side and extending transversely outward therefrom, said attachment plate of each beam structure fixedly securable to said roof deck.

13. A system as in claim 1 wherein each of said beam structures comprises a plurality of elongated channels formed on at least one side face thereof, each of said channels dimensioned to receive and retain a correspondingly positioned longitudinal end of one of said plurality of baffle plates.

14. A system as in claim 13 wherein cooperatively positioned ones of said plurality of channels on adjacent ones of said beam structures are disposed in co-planar relation to one another and co-planar pairs of said channels are disposed to receive opposite ends of a common baffle plate.

15. A system as in claim 1 wherein at least one of said beam structures is an end most beam structure and a plurality of secondary baffle plates are secured transversely to an outer surface thereof, each of said secondary baffle plates having a proportionally greater transverse dimension from said first end towards the second end and each including an angularly declining upper longitudinal side extending from said end-most beam structure to an outer distal end of said respective secondary baffle plate which defines said second end thereof.

16. A system as in claim 1 further comprising tie-end means for forming a sloped roof extension between a gabled roof surface and one longitudinal end of assembled ones of said beams and baffle plates; said tie-end means including a plurality of parallel beam extensions secured to a correspondingly positioned end-most baffle plate and extending outwardly therefrom into engagement with a sloped gabled roof surface; a plurality of grill structures secured to an upper portion of adjacent ones of said beam extensions in overlying relation to a confined space therebetween and including an open, pass-through construction for directing a moldable roofing material therethrough into said confined space.

17. A system as in claim 16 wherein said auxiliary grill structures and said beam extensions are cooperatively disposed and configured to define a sloped disposition between the gabled roof surface and said one longitudinal end of said assembled ones of said beams and baffle plates.

* * * * *